US009394729B2

(12) United States Patent
Da Deppo et al.

(10) Patent No.: US 9,394,729 B2
(45) Date of Patent: Jul. 19, 2016

(54) VEHICULAR DOOR HANDLE ASSEMBLY WITH ELECTRICALLY DEPLOYABLE LATCH CONNECTION

(71) Applicant: Huf North America Automotive Parts Mfg. Corp., Milwaukee, WI (US)

(72) Inventors: Lynn D. Da Deppo, Bloomfield Hills, MI (US); Ehab Kamal, Novi, MI (US)

(73) Assignee: Huf North America Automotive Parts Mfg. Corp., Milwaukee, WI (US)

( * ) Notice: Subject to any disclaimer, the term of this patent is extended or adjusted under 35 U.S.C. 154(b) by 274 days.

(21) Appl. No.: 13/959,269

(22) Filed: Aug. 5, 2013

(65) Prior Publication Data

US 2014/0015263 A1 Jan. 16, 2014

Related U.S. Application Data

(63) Continuation-in-part of application No. 13/828,261, filed on Mar. 14, 2013.

(60) Provisional application No. 61/670,466, filed on Jul. 11, 2012.

(51) Int. Cl.
*E05B 3/00* (2006.01)
*E05B 85/16* (2014.01)
(Continued)

(52) U.S. Cl.
CPC ..... *E05B 85/16* (2013.01); *E05B 47/06* (2013.01); *E05B 47/0676* (2013.01); *E05B 77/04* (2013.01); *Y10T 292/57* (2015.04)

(58) Field of Classification Search
CPC . Y10T 16/458; Y10T 70/7062; Y10T 292/57; E05C 77/06; E05C 77/04; E05C 7/00; E05B 85/10; E05B 81/76; E05B 95/16; E05B 85/16; E05B 47/06; E05B 47/0676; E05B 77/04
USPC ..... 292/336.3, DIG. 65, 92; 16/413, 412, 16/458; 340/5.62, 5.72
See application file for complete search history.

(56) References Cited

U.S. PATENT DOCUMENTS 2,029,197 A * 1/1936 Roedding ..... 292/221
2,485,000 A * 10/1949 Jakeway ..... 292/167
3,020,075 A * 2/1962 Johnstone et al. ..... 292/336.3
(Continued)

FOREIGN PATENT DOCUMENTS

DE 3500550 A1 * 10/1985 ..... E05B 65/20
DE WO 2008152047 A1 * 12/2008 ..... E05B 79/06
(Continued)

*Primary Examiner* — Kristina Fulton
*Assistant Examiner* — Faria Ahmad
(74) *Attorney, Agent, or Firm* — Honigman Miller Schwartz and Cohn LLP; Matthew H. Szalach; Jonathan P. O'Brien

(57) ABSTRACT

A handle assembly for preventing inadvertent opening of a motor vehicle door during a crash event. The handle assembly includes an activation mechanism coupled to an electrically-activated leg. When the activation mechanism is activated, then the electrically-activated leg is moved to an engaged position to engage an actuation pawl to prevent rotation of the actuation pawl so that, upon actuation of a handle strap, the actuation pawl engages and actuates the door latch release. However, if the activation mechanism is not activated, then the leg does not engage the pawl, and a movement of the handle strap does not actuate the door latch release as the pawl is permitted to rotate.

18 Claims, 12 Drawing Sheets

(51) Int. Cl.
*E05B 77/04* (2014.01)
*E05B 47/06* (2006.01)

(56) References Cited

U.S. PATENT DOCUMENTS

| | | | | | |
|---|---|---|---|---|---|
| 3,159,415 | A * | 12/1964 | Sandor | 292/336.3 | |
| 3,858,921 | A * | 1/1975 | Kuki | 292/336.3 | |
| 4,475,754 | A * | 10/1984 | Arlauskas et al. | 292/336.3 | |
| 4,482,179 | A * | 11/1984 | Johnson | 292/336.3 | |
| 4,895,403 | A * | 1/1990 | Osenkowski | 292/336.3 | |
| 5,123,687 | A * | 6/1992 | Pfeiffer et al. | 292/336.3 | |
| 5,421,061 | A * | 6/1995 | Kolle et al. | 292/336.3 | |
| 5,860,684 | A * | 1/1999 | Mizuki | 292/336.3 | |
| 5,887,918 | A * | 3/1999 | Okada et al. | 292/336.3 | |
| 5,975,597 | A * | 11/1999 | Makiuchi et al. | 292/336.3 | |
| 6,007,122 | A * | 12/1999 | Linder et al. | 292/336.3 | |
| 7,097,216 | B2 * | 8/2006 | Lane et al. | 292/216 | |
| 7,145,436 | B2 * | 12/2006 | Ichikawa | E05B 85/01 | 340/5.72 |
| 7,217,899 | B2 * | 5/2007 | Hidaka et al. | 200/600 | |
| 7,437,803 | B2 * | 10/2008 | Watanabe et al. | 16/412 | |
| 7,635,151 | B2 * | 12/2009 | Rodawold et al. | 292/336.3 | |
| 7,677,614 | B2 * | 3/2010 | Monig | 292/336.3 | |
| 8,424,936 | B2 * | 4/2013 | Muller et al. | 292/336.3 | |
| 9,062,477 | B2 * | 6/2015 | Da Deppo et al. | | |
| 2002/0046440 | A1 * | 4/2002 | Agostini et al. | 16/110.1 | |
| 2002/0059693 | A1 * | 5/2002 | Jooss et al. | 16/412 | |
| 2005/0161959 | A1 * | 7/2005 | Belchine, III | 292/336.3 | |
| 2005/0236846 | A1 * | 10/2005 | Hidaka et al. | 292/216 | |
| 2006/0005590 | A1 * | 1/2006 | Schmidt et al. | 70/257 | |
| 2006/0038418 | A1 * | 2/2006 | Huizenga et al. | 292/336.3 | |
| 2006/0232378 | A1 * | 10/2006 | Ogino et al. | 340/5.62 | |
| 2007/0018790 | A1 * | 1/2007 | LaFrance | 340/5.72 | |
| 2007/0046080 | A1 * | 3/2007 | Muneta | 297/184.13 | |
| 2007/0294861 | A1 * | 12/2007 | Cummins et al. | 16/412 | |
| 2008/0028885 | A1 * | 2/2008 | Monig | 74/523 | |
| 2008/0036219 | A1 * | 2/2008 | Savant et al. | 292/336.3 | |
| 2008/0079537 | A1 * | 4/2008 | Touge | 340/5.72 | |
| 2009/0026774 | A1 * | 1/2009 | Watanabe et al. | 292/336.3 | |
| 2009/0302620 | A1 * | 12/2009 | Muller et al. | 292/336.3 | |
| 2010/0088855 | A1 * | 4/2010 | Ruse et al. | 16/412 | |
| 2010/0127516 | A1 * | 5/2010 | Fannon | 292/336.3 | |
| 2010/0230980 | A1 * | 9/2010 | Ichikawa et al. | 292/336.3 | |
| 2011/0115240 | A1 * | 5/2011 | Muller et al. | 292/336.3 | |
| 2011/0163554 | A1 * | 7/2011 | Patel | 292/216 | |
| 2011/0174029 | A1 * | 7/2011 | Lappalainen et al. | 70/279.1 | |
| 2011/0204662 | A1 * | 8/2011 | Savant et al. | 292/336.3 | |
| 2013/0187394 | A1 * | 7/2013 | Lesueur et al. | 292/336.3 | |
| 2013/0221690 | A1 * | 8/2013 | Rocci et al. | 292/336.3 | |
| 2013/0233034 | A1 * | 9/2013 | Ono et al. | 70/101 | |
| 2014/0015640 | A1 * | 1/2014 | Hourne et al. | 340/5.72 | |
| 2014/0049058 | A1 * | 2/2014 | Kudoh et al. | 292/336.3 | |
| 2014/0117683 | A1 * | 5/2014 | Saitou | 292/336.3 | |
| 2014/0145454 | A1 * | 5/2014 | Da Deppo et al. | 292/336.3 | |
| 2014/0203574 | A1 * | 7/2014 | Noda et al. | 292/336.3 | |
| 2014/0292005 | A1 * | 10/2014 | Bendel et al. | 292/336.3 | |
| 2014/0375069 | A1 * | 12/2014 | Niegeloh et al. | 292/336.3 | |
| 2015/0054617 | A1 * | 2/2015 | Fontanet et al. | 340/5.72 | |
| 2015/0091311 | A1 * | 4/2015 | Witte et al. | 292/336.3 | |

FOREIGN PATENT DOCUMENTS

| | | | | |
|---|---|---|---|---|
| DE | 102012104777 | A1 * | 12/2013 | E05B 77/42 |
| EP | 1586726 | A1 * | 10/2005 | E05B 65/20 |
| EP | 1950366 | B1 | 7/2008 | |
| IT | EP 1950366 | B1 * | 1/2010 | E05B 77/04 |
| WO | WO 2011077222 | A2 * | 6/2011 | E05B 65/20 |

* cited by examiner

VEHICULAR DOOR HANDLE ASSEMBLY WITH ELECTRICALLY DEPLOYABLE LATCH CONNECTION

CROSS-REFERENCE TO RELATED APPLICATIONS

This application is a continuation-in-part application of U.S. non-provisional patent application Ser. No. 13/828,261 filed on Mar. 14, 2013, and claims the benefit of U.S. provisional patent application Ser. No. 61/670,466 filed on Jul. 11, 2012. The contents of both of these applications are incorporated by reference for all purposes as if set forth in their entirety herein.

STATEMENT OF FEDERALLY SPONSORED RESEARCH OR DEVELOPMENT

Not applicable.

BACKGROUND

This disclosure relates to a handle assembly for a motor vehicle door. More particularly, it relates to a handle assembly having a selectively deployable connection which reduces the likelihood of the unintended opening of the door during a crash event.

Conventionally, motor vehicles include at least one outside door handle for releasing a door latch mechanism in order to open a door. Typically, a user actuates the outside door handle by pulling a handle strap relative to a fixed base. This causes the release of a door latch which, in turn, permits the door to swing open.

The handle strap may, however, also be activated when the outside door handle experiences a high inertia force such as during an automotive accident. The movement of the handle strap relative to the base in response to the high inertia force can cause inadvertent unlatching and result in the opening of the door.

In recent years, there has been development of locking mechanisms to attempt to prevent the opening of a vehicular door in the event of such a high inertia force. While these mechanisms work for some crash situations, high acceleration impact or other vehicular crash events may result in forces that overcome these locking devices.

Accordingly, there is a continued need for handle assemblies that are not susceptible to the effects of high inertial forces such as those imposed during a vehicular crash.

SUMMARY OF THE INVENTION

A handle assembly is disclosed that has a structure that decouples the effect of inertial forces on the handle strap from the door unlatching system. To release the door latch in the disclosed handle assembly, an electrically-activated leg is actuated via an activation mechanism before the handle strap is pulled or otherwise actuated. The activation of the leg results in the engagement of the leg with a potentially rotatable pawl so that, when the pawl is moved with the handle strap, the pawl engages a door latch release so as to operate the door latch release. However, if the leg is not activated to engage the pawl and the handle strap is moved, then the pawl is permitted to rotate past the door latch release and the door latch is not released.

This means that, if any inertial or other forces induced by an event such as a crash cause the handle strap to be actuated or moved without activation of the leg first, then the door latch will not be released as a result of handle movement. Accordingly, this improved handle assembly can improve safety in the event of a car accident by helping to prevent the door from unintentionally opening under the forces of a crash.

According to one aspect of the invention, a handle assembly is disclosed that prevents the inadvertent opening of a motor vehicle door during a crash event. The handle assembly includes a base fixedly secured to the motor vehicle door. A handle strap of the assembly extends between a handle end and a base end and is pivotal about the base end. The handle end extends through an aperture in the base. An electrically-activated leg extends through the handle end of the handle strap. The handle assembly further includes an actuation pawl for selective engagement and actuation with a door latch release. The actuation pawl is disposed proximate a free end of the electrically-activated leg and is rotatably attached to the handle end of the handle strap. An activation mechanism is coupled to the electrically-activated leg.

When the activation mechanism is activated, then the electrically-activated leg is moved to a first position to engage the actuation pawl. This engagement prevents rotation of the actuation pawl so that, upon actuation of the handle strap, the actuation pawl engages and actuates the door latch release.

When the activation mechanism is not activated, then the actuation pawl may be rotatable with minimal to no load and thus may not transmit appreciable force to the door latch release. For example, if the activation mechanism is not activated, then the electrically-activated leg may be in a second position in which the electrically-activated leg does not engage the actuation pawl. In this position, the actuation pawl may be permitted to rotate such that a movement of the handle strap does not cause the actuation pawl to actuate the door release latch. Accordingly, if the activation mechanism is not activated and the electrically-activated leg does not engage the actuation pawl, when inertial forces are applied to the handle assembly, then the movement of the handle strap may not result in the actuation pawl actuating the door release latch.

In some forms, the electrically-activated leg may be actuatable between the first position in which the electrically-activated leg engages the actuation pawl and a second position in which the electrically-activated leg does not engage the actuation pawl. In order to effectuate actuation to the engaged first position, the handle assembly may further include, for example, a solenoid that actuates the electrically-activated leg. The electrically-activated leg may be telescopically received inside the coil of the solenoid. The solenoid may be received in a housing and the electrically-activated leg may be (at least partly) received in an opening extending through the housing. The housing may be received in the handle end of the handle strap and the electrically-activated leg may be captured between the housing and the handle end of the handle strap. Even captured between the housing and the handle end, however, the leg may be movable such that an end of the electrically-activated leg is extendable from the handle end to selectively engage the actuation pawl.

A biasing spring may work in conjunction with the solenoid. The biasing spring may bias the electrically-activated leg to the second position in which the electrically-activated leg does not engage the actuation pawl. The solenoid may actuate the electrically-activated leg against the biasing spring to move the leg from the second position to the first position in which the electrically-activated leg engages the actuation pawl.

Various types of activation mechanisms are contemplated and the actuation mechanism may be electrically coupled to the electrically-activated leg. For example, the activation mechanism may be a capacitive field activation mechanism (such that, for example, the presence of a hand of the user around the handle strap changes the capacitive field to activate the capacitive field activation mechanism) or the activation mechanism may be an electromechanical switch (for example, an electromechanical switch activated by the depression of a button or a handle grip relative to the handle strap).

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENTS

Referring first to FIGS. 1A, 1B, 2A, and 2B, one embodiment of a handle assembly 10 according to the present invention is shown disposed on a motor vehicle door 12.

Figure 1A:
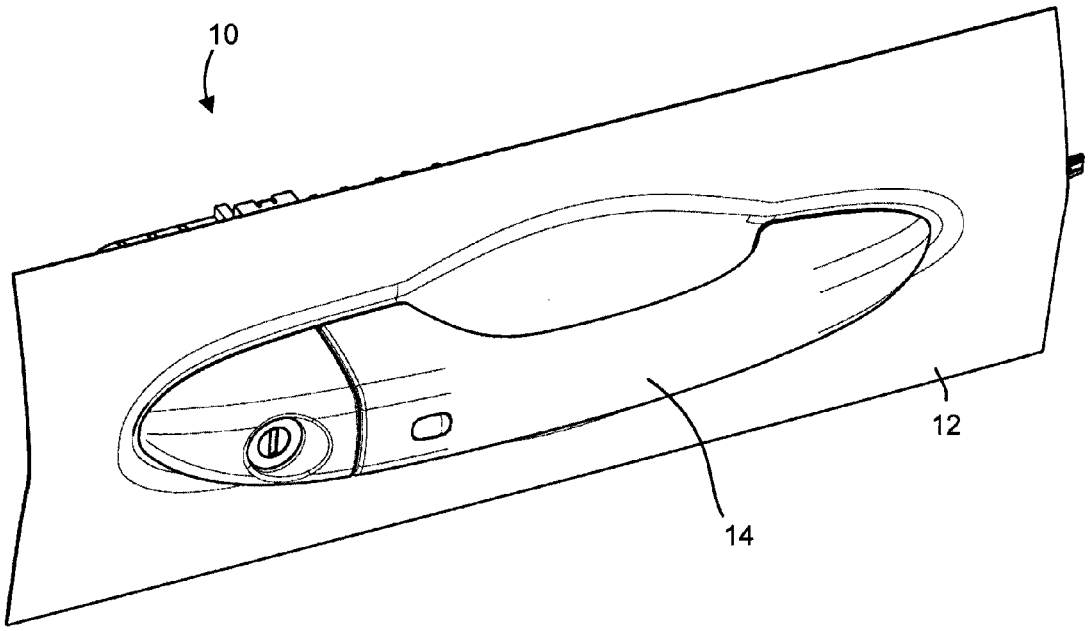
FIGS. 1A and 1B are views of a handle assembly in a vehicle door in which the handle is not engaged or operated.
Figure 1B:
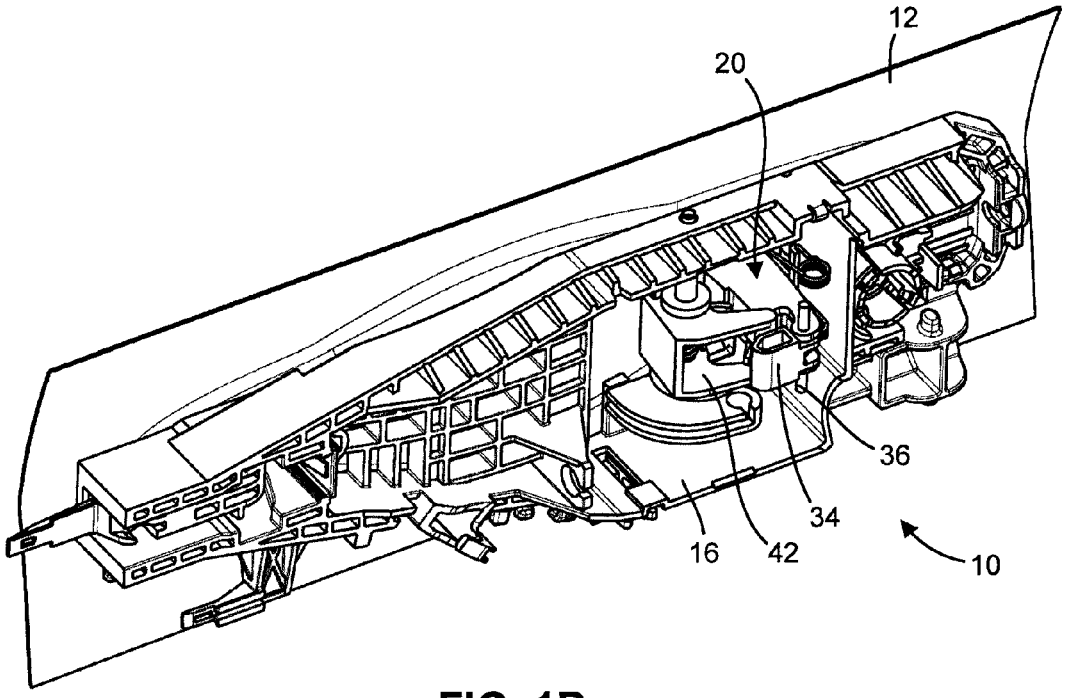

In FIG. 1A, the handle strap 14 of the handle assembly 10 is shown in the closed position on the front side of the door 12. FIG. 1B illustrates the rear side of handle assembly 10 (which is inside the door 12) when the handle strap 14 is closed (i.e., not actuated, pulled, or otherwise moved) and the arrangement of the various parts which will be described in further detail below. In this position of the handle strap 14, the door latch is not released which means that if the door 12 is closed, then the door 12 is prevented from swinging away from the car body or that, if the door 12 is originally open and then closed that, after closing, the door 12 will be prevented from swinging away from the body of the car.

Figure 2A:
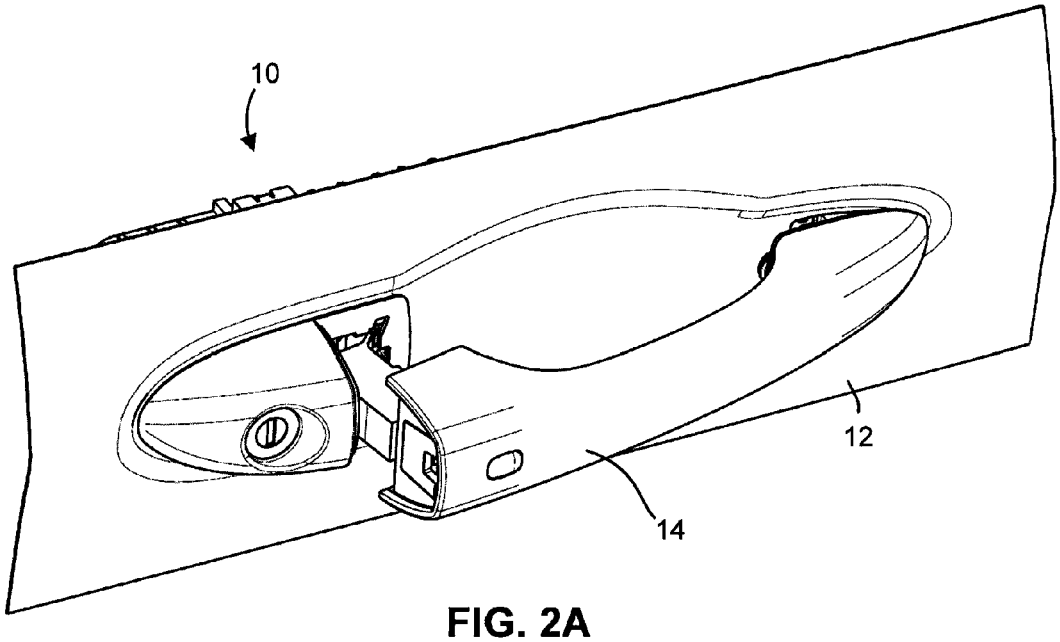
FIGS. 2A and 2B are views of the handle assembly in FIGS. 1A and 1B in which a handle grip or actuation pad has been depressed and the handle pulled.
Figure 2B:
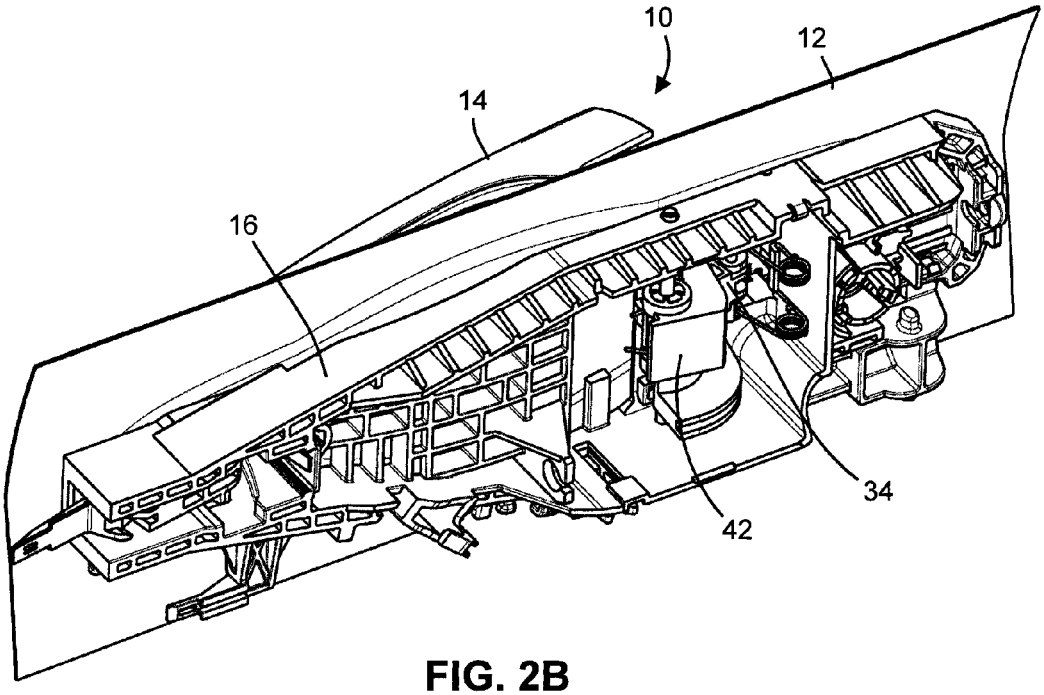
Figure 3A:
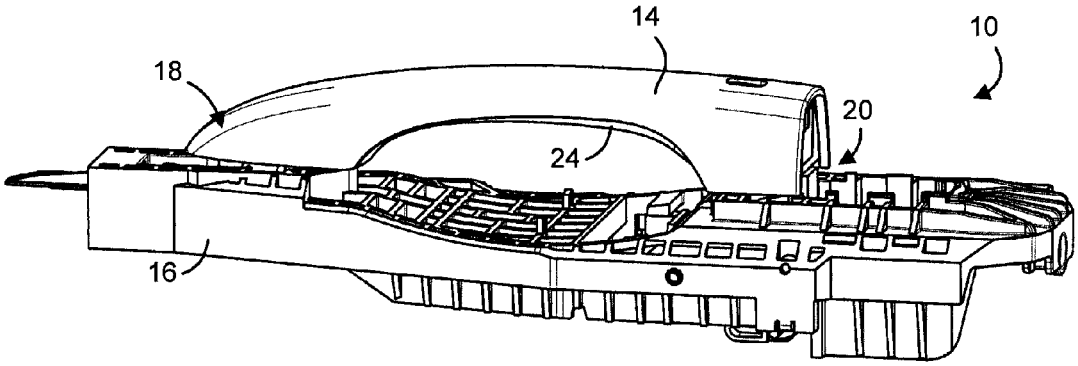
FIG. 3A is a portion of the handle assembly apart from the door.
Figure 3B:
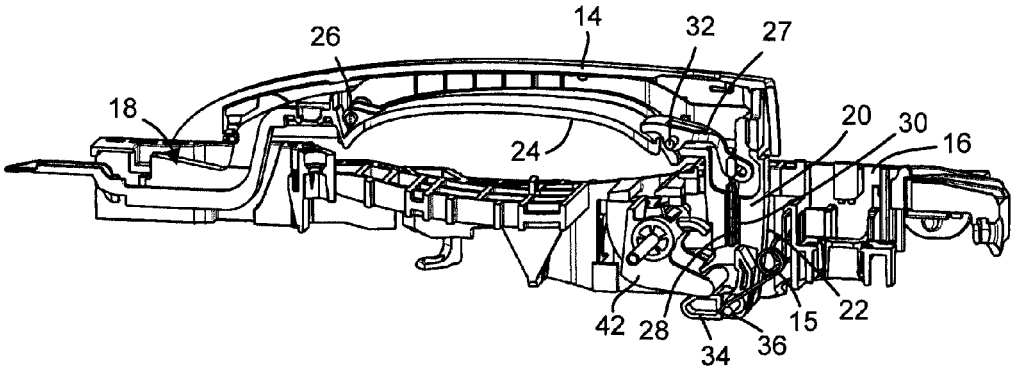
FIG. 3B is a partial cross-sectional view of the handle assembly of FIG. 3A.
Figure 3C:
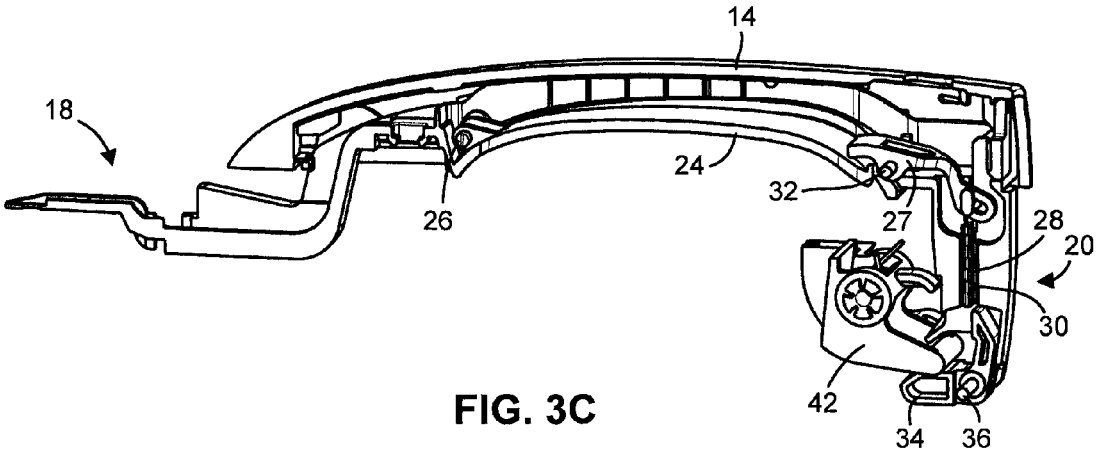
FIG. 3C is the handle assembly of FIG. 3B in which the base is removed to better highlight some of the internal components of the handle assembly.
Figure 4A:
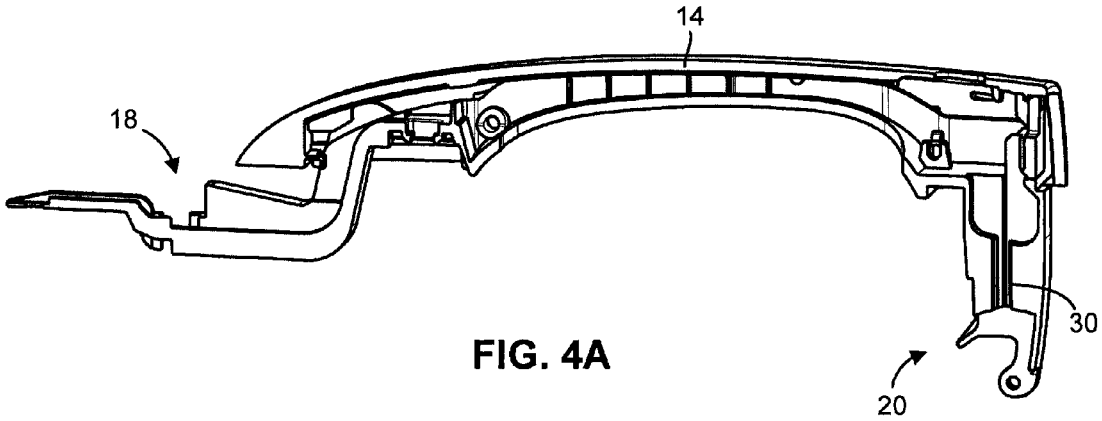
FIGS. 4A through 4F separately illustrate some of the components of the handle assembly.
Figure 4B:
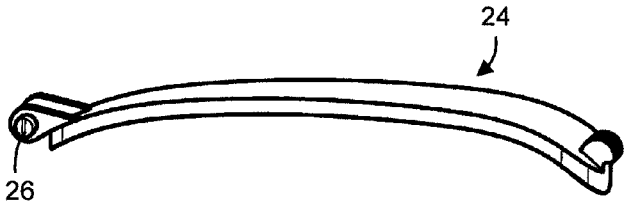
Figure 4C:
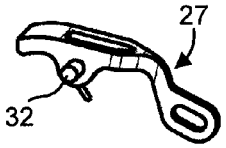
Figure 4D:
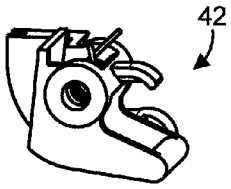
Figure 4E:
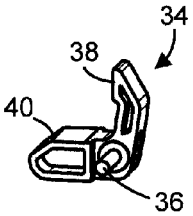
Figure 4F:
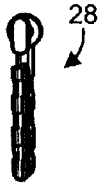

In FIG. 2A, the handle strap 14 of the handle assembly 10 is shown in the open position in which the handle strap 14 has been pulled or actuated away from the door 12. Additionally, although it cannot be seen in this view, the handle grip 24 has been actuated or depressed prior to the movement of the handle strap 14. FIG. 2B illustrates the rear side of the handle assembly 10, when the handle strap 14 and the handle grip have been actuated. By moving the handle strap 14 to the position in FIGS. 2A and 2B and actuating the handle grip, the door latch can be released to permit the opening of the door 12. The handle strap 14 is biased to the closed position of FIGS. 1A and 1B using a spring 15 such as is illustrated in FIGS. 5A through 5C and 6A through 6C.

Now with additional reference to FIGS. 3A through 3C and 4A through 4E, the various parts of the handle assembly 10 are illustrated.

As best seen in FIGS. 1B, 2B, 3A, and 3B, the handle assembly 10 includes a base 16 which is fixed to the door 10. A base end 18 of the handle strap 14 is pivotally fixed to one end of the base 16 while a handle end 20 can extend at least part way through an opening 22 proximate the other end of the base 18. As noted above, the base 16 and handle strap 14 are configured such that the handle strap 14 is generally biased to the closed position illustrated in FIGS. 1A and 1B, but this biasing force may be overcome when the handle strap 14 is pulled away from the base 16.

Returning to the handle strap 14, it can be seen that the side of the handle strap 14 facing the door 12 includes a handle grip 24 or user-actuatable pad. In the form illustrated, one end of this handle grip 24 is pivotally connected to the handle strap 14 about a pin/axis 26 proximate the base end 18 of the handle strap 14. On the other end of the handle grip 24, which is closer to the handle end 20 of the handle strap 14, the handle grip 24 is connected to a linking member 27. This linking member 27 connects to a leg 28 or blocking link.

The leg 28 extends through an opening 30 that extends through the handle end 20 of the handle strap 14. On one end of the leg 28, the leg 28 is connected to the linking member 27 which is, in turn, connected to the free end (i.e., not pivotally fixed end) of the handle grip 24. The connection of the leg 28 to the linking member 27 occurs on the side of the opening 30 which is closest to the outside of the door 12. On the other side of the opening 30 (which faces the inside of the door 12), a free end of the leg 28 is situated. This free end may either be positioned in the opening 30 or project some distance out from the opening 30.

Based on the arrangement of the handle strap 14, the handle grip 24, the linking member 27, and the leg 28, the actuation of the handle grip 24 relative to and toward the handle strap 14 (for example, by squeezing the handle grip 24 into the handle strap 14) can cause the linking member 27 to rotate about a pivot point 32. This rotation of the linking member 27 causes the leg 28 attached to the linking member 27 to move out of the opening 30 of the handle end 20 of the handle strap 14 (or to move further out of the opening 30, depending on the original position of the leg 28).

It should be noted that typically this arrangement of the handle strap 14, the handle grip 24, the linking member 27, and the leg 28, can be biased to the position in which the leg 28 is retracted and the handle grip 24 is moved away from the handle strap 14. This could be done in a number of ways including, for example, biasing the handle grip 14 and/or the linking member 27 using a spring, although other biasing mechanisms could be utilized. In the particular form shown, it appears a spring is disposed in the linking member 27 to effectuate a counter clockwise bias of the linking member 27 (relative to the orientation depicted in FIG. 3C).

On the far end of the handle end 20, proximate the opening from which the leg 28 is extendable, there is an actuation pawl 34. This actuation pawl 34 is L-shaped and pivotable about its bend at pin 36 (which is fixed relative to the handle end 20) which also engages the spring 15 to bias the handle strap 14 into the closed position. In the view illustrated in FIG. 3C, this actuation pawl 34 is biased in a clockwise direction using another spring, although other biasing members could be utilized. When biased into position, the actuation pawl 36 has a first segment 38 that extends up toward the opening 30 for engagement with the leg 28 and a second segment 40 spaced approximately 90 degrees from the first segment 38 that extends in a direction back toward the base end 18 of the handle strap 14.

This second segment 40 is arranged to engage a latch cable release cam 42 when the handle strap 14 is opened or actuated and the handle end 20 is moved. If this second end 40 of the actuation pawl 34 applies a force above a threshold force to the latch cable release cam 42, the latch cable release cam 42 will rotate, ultimately resulting in the release of the door latch (not shown).

However, unless the handle grip 24 is actuated and the leg 28 or blocking link is extended, the actuation pawl 34 will rotate when the handle strap 14 is pulled because the resistive force on the second segment 40 of the actuation pawl 34 will exceed the bias force of the actuation pawl 34. Only when the handle grip 24 is first pulled will the leg 28 or blocking link be extended and inhibit the rotation of the actuation pawl 34 by engagement with the first segment 38 of the actuation pawl 34. With the leg 28 extended and the actuation pawl 34 unable to rotate, the opening of the handle strap 14 will move the actuation pawl 34 into engagement with the latch cable release cam 42 and force the latch cable release cam 42 to rotate, which opens the door.

FIGS. 5A through 5C and FIGS. 6A through 6C illustrate the difference between actuation of the handle strap 14 when the handle grip 24 is depressed or actuated and when it is not, respectively.

Figure 5A:
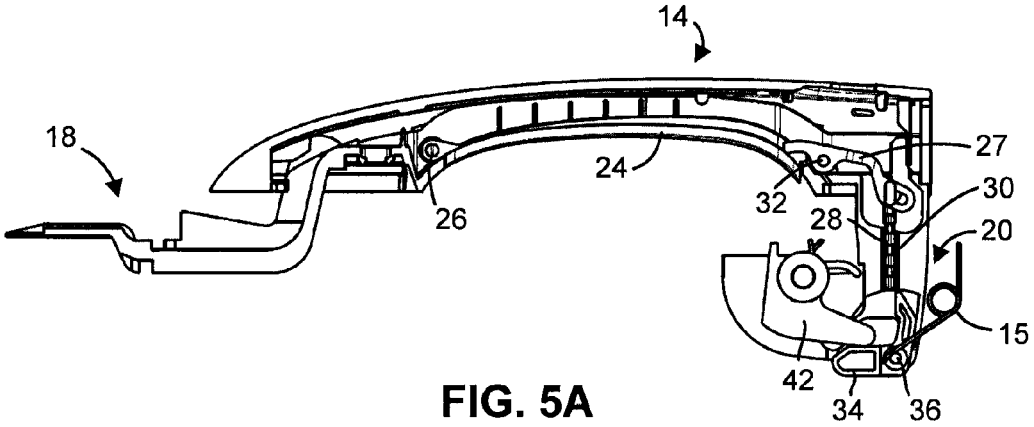
FIGS. 5A through 5C illustrate stepwise how the handle assembly is made to actuate a cable release cam when the handle grip is depressed and the handle pulled.
Figure 5B:
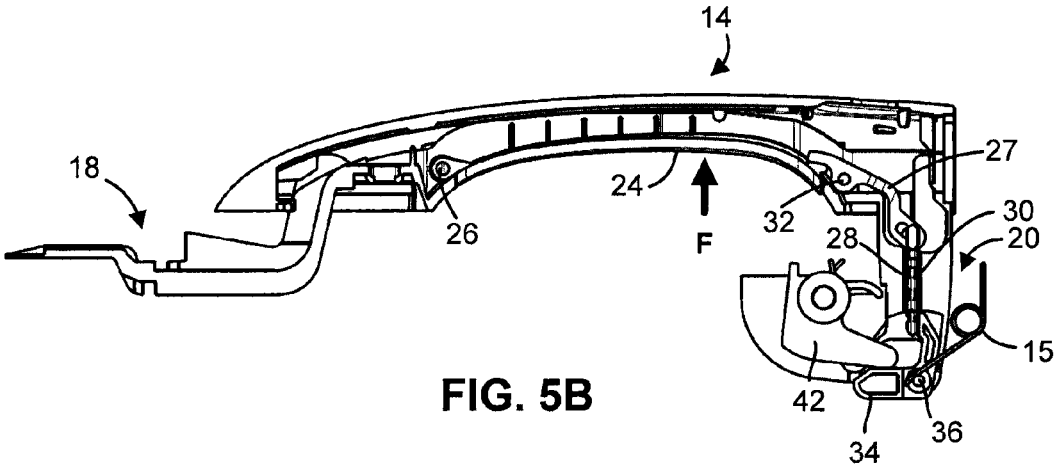
Figure 5C:
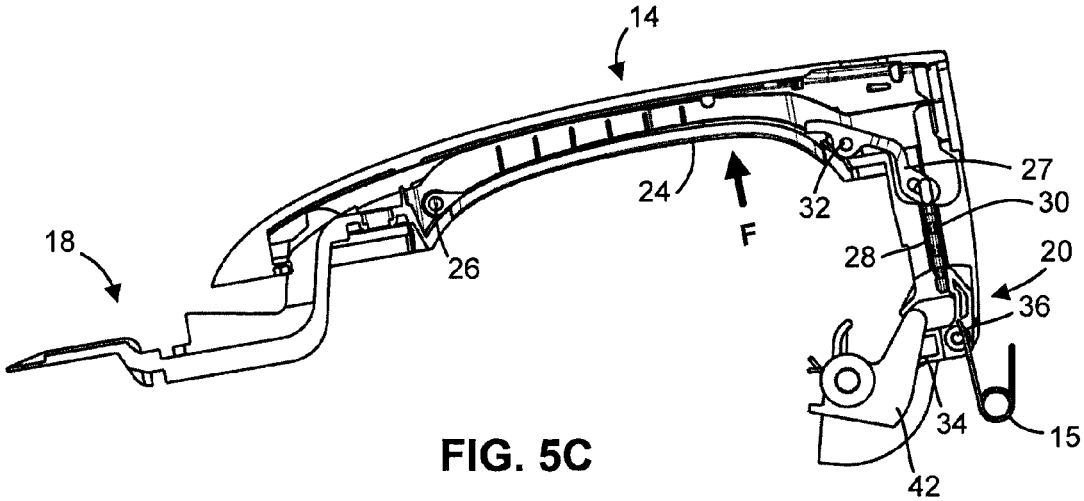

FIG. 5A illustrates a portion of the handle assembly 10 when the handle strap 14 is closed and the handle grip 24 is biased into the unactuated position. FIG. 5B illustrates the application of a force F to actuate the handle grip 24 thereby effectuating the extension of the leg 28 to a position in which it may engage with the actuation pawl 34. Then, in FIG. 5C, the handle strap 14 is rotated out from the door 12 while the handle grip 24 remains actuated. This causes the second segment 40 of the actuation pawl 34 to be forced into engagement with the latch cable release cam 42 and for the latch cable release cam 42 to rotate (which will release the door latch).

Figure 6A:
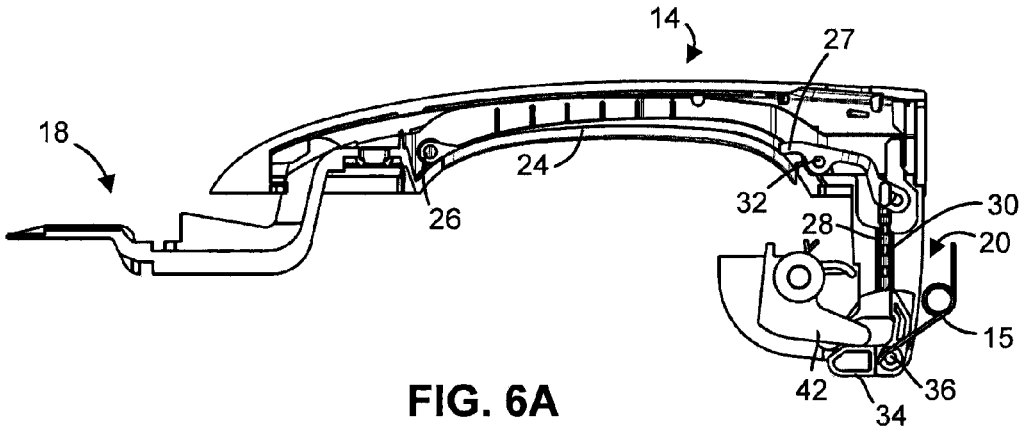
FIGS. 6A through 6C illustrate stepwise how, when the handle grip is not depressed and the handle is moved, the cable release cam is not actuated.
Figure 6B:
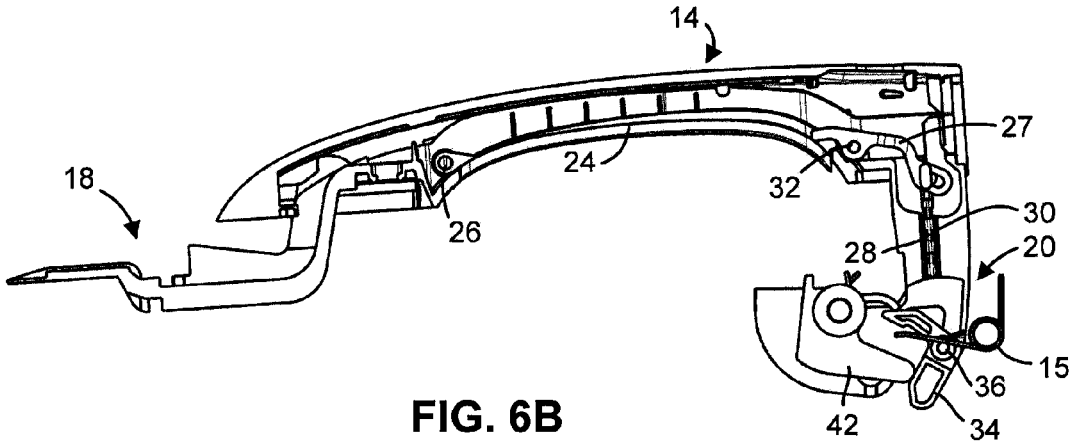
Figure 6C:
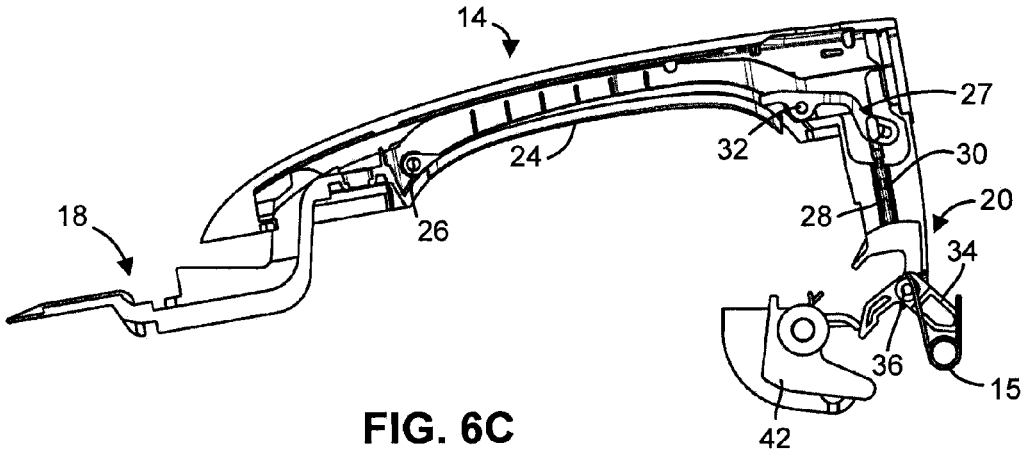

In contrast, FIGS. 6A through 6C depict an arrangement of steps in which the handle grip 24 is not actuated before the handle strap 14 is opened. FIG. 6A is similar to FIG. 5A in which the handle assembly 10 is closed and all parts are biased to their unactuated positions. Then in FIGS. 6B and 6C, the handle strap 14 is opened without first depressing the handle grip 24. Because the leg 28 or blocking link was not extended and engaging the first segment 40, the actuation pawl 34 begins rotating as it engages the latch cable release cam 42. Rather than effectuate the rotation of the latch cable release cam 42, the movement of the handle strap 14 simply moves the actuation pawl 34 past the latch cable release cam 42 as the actuation pawl 34 rotates to avoid actuation of the latch cable release cam 42.

This described structure is beneficial in the event of a vehicle crash. Often inertia forces can cause a handle strap to move relative to the door and fixed base. In a typical handle assembly, this may mean that the latch mechanism is engaged causing the release of the door latch. Once the door latch is released, the door may swing open, particularly if the door is not locked. The described arrangement, however, separately requires the actuation of the handle grip 24 in order for the latch mechanism to be engaged. This means that by controlling the biasing forces on the handle strap 14 and the handle grip 24, in a crash event the handle strap 14 may be configured to move outward before the handle grip 24 is actuated under additional inertia forces. However, by the time the handle strap 14 is moved outward, the actuation pawl 34 has already passed the latch cable release cam 42, so the further actuation of the handle grip 24 and the leg 28 will not cause the door latch to release.

Moreover, the disclosed handle assembly can reduce the likelihood of release of the latch due to crash-induced door deformation. As the handle strap is uncoupled from the latch release, the forces imparted by deformation should not be sufficient to transfer load sufficient to cause latch activation. This is another non-user operated condition in which, without actuation of the handle grip, the handle strap will not be operably coupled to the door latch mechanism.

In addition to the coupling mechanism disclosed above, there are other alternative coupling mechanisms that can likewise be employed in order to achieve the same effect (i.e., only cause the latch to be released after the handle grip has been actuated, but not under the conditions of an accident or crash).

Figure 7A:
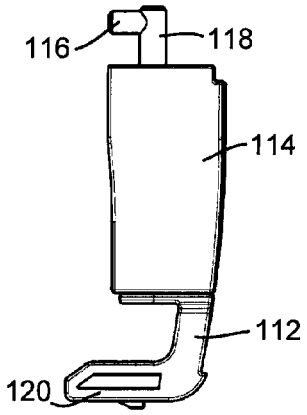
FIGS. 7A through 7F illustrate a release mechanism for a handle assembly with a rotating pawl.
Figure 7B:
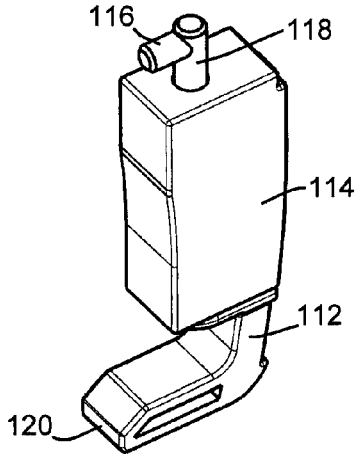

Turning now to FIGS. 7A through 7F, a portion of a first alternative selective coupling mechanism 110 is illustrated. In this alternative selective coupling mechanism 110, an actuation pawl 112 is rotatably disposed in a sub-housing 114. This sub-housing 114 may be part of and move with a handle strap, although this is not illustrated in the figures so as to provide a clear view of the parts that differ from the previously described handle assembly and to better highlight its mode of operation. As best illustrated in FIGS. 7A and 7B, a first portion of the actuation pawl 112 extends from a one end of the sub-housing 114 and includes a transverse stub 116 that extends from an axially-extending post 118. Although not illustrated, the transverse stub 116 is attached to a linkage, rocker, or the like that connects to the handle grip or pad (such as the grip 24 in the previous embodiment). A second portion of the actuation pawl 112 extends from the other end of the sub-housing 114 and includes a hook end 120 that is generally L-shaped. It is contemplated that these first and second portions may be unitary or, alternatively, there may be some mechanical linkages inside the sub-housing 114 which cause the actuation of the first portion to cause the rotation described below of the second portion having the hook end 120.

Figure 7C:
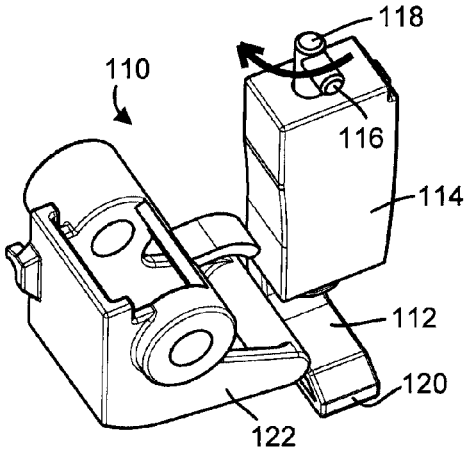
Figure 7D:
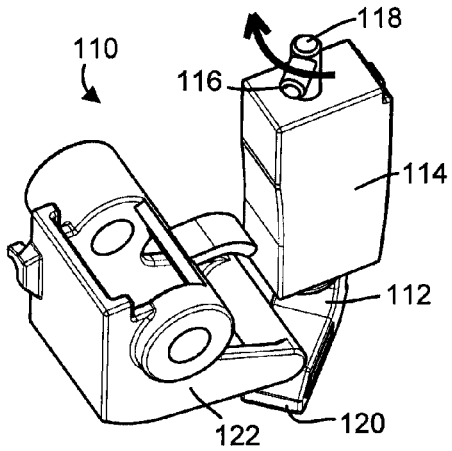
Figure 7E:
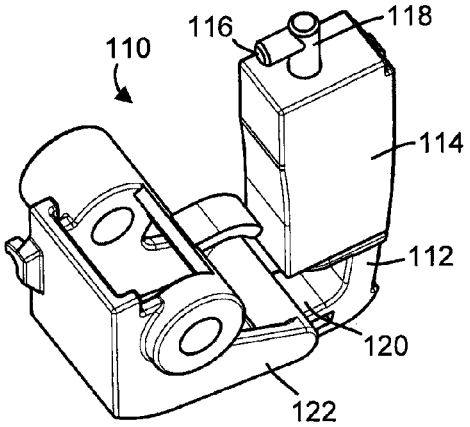

In FIGS. 7C through 7E, the actuation pawl 112 and sub-housing 114 are shown with a latch cable release cam 122 that performs a similar function to the latch cable release cam 42 described above. It can be seen that the axis of rotation of the actuation pawl 112 in this embodiment is generally perpendicular to the axis of rotation of the latch cable release cam 122 so that the hook end 120 of the actuation pawl 112 can be made to selectively engage latch cable release cam 122 when the sub-housing 114 and actuation pawl are moved together (such as by opening an attached handle strap) after the pawl 112 has been rotated into place for opening.

Looking specifically at FIG. 7C, the release mechanism is shown in the "rest" position in which the handle grip is not depressed and the handle strap has not been pulled. In this position, the hook end 120 of the actuation pawl 112 is rotated sufficiently away from the cable release cam 122 to ensure the two elements do not create a connection; in the figure it is shown as 90 degrees for illustrative purposes. This rotational placement may be established by a biasing mechanism, such as for example, a spring, inside the sub-housing 114. With the hook end 120 in this position, if the sub-housing 114 and the actuation pawl 112 were suddenly and abruptly moved as the result of inertial force or the like on the handle, then the actuation pawl 112 would move past the latch cable release cam 122 without engaging it and releasing the latch.

Figure 7F:
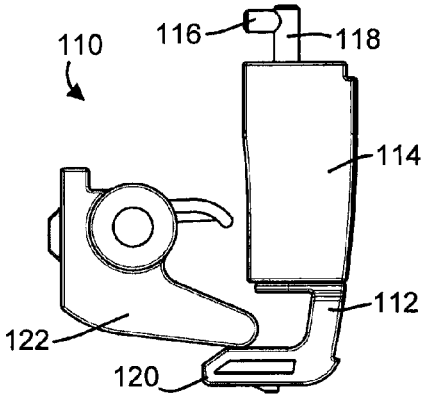

Looking now at FIG. 7D, the actuation pawl 112 is shown partially rotated after the handle grip has begun to be depressed and in an intermediately depressed position. During depression of the handle grip, the stub 116 on the axially-extending post 118 is engaged by a linkage, rocker, or so forth to cause to rotation of the actuation pawl 112. As a result of this engagement and rotation on the first portion, the hook end 120 of the actuation pawl 112 is rotated toward the latch cable release cam 122. The final position of the actuation pawl 112 is illustrated in FIGS. 7E and 7F, after the handle grip is completely depressed (which in one particular embodiment involves travel of the handle grip approximately 3 mm and before the handle strap is pulled). In this final position, the hook end 120 has swung the appropriate degrees to create the desired connection, shown here as 90 degrees from its original, biased position from which it was clear of the latch cable release cam 122 to its final position in which it is aligned with the latch cable release cam 122. Once the hook end 120 has been actuated into place, if the sub-housing 114 and actuation pawl 112 are moved as the result of pulling the handle strap, then the hook end 120 of the actuation pawl 112 will engage the latch cable release cam 122 to effectuate release of the latch.

Again, because the actuation pawl 112 is biased, the actuation pawl 112 will rotate back to the position illustrated in FIG. 7C once the handle grip is released.

Turning now to FIG. 8A through 8F, yet another selective coupling mechanism 210 is illustrated. This selective coupling mechanism 210 includes a separable or floating pawl configuration in which a pawl segment 212 is selectively locked to a handle strap segment 214 (which may be attached to or integrally formed with the handle strap, such as the handle strap illustrated above).

Figure 8A:
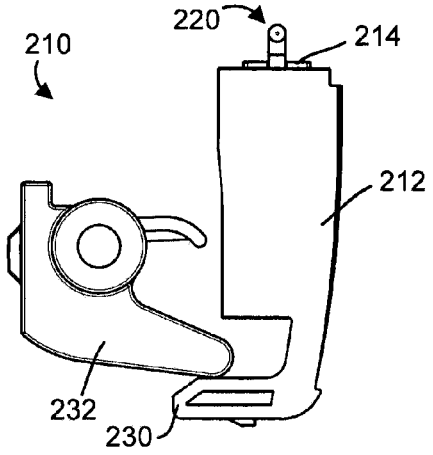
FIGS. 8A through 8F illustrate a release mechanism for a handle assembly in which a pin wedge selectively engages transverse pins to selectively lock or couple a portion of the handle strap segment to the pawl segment.
Figure 8B:
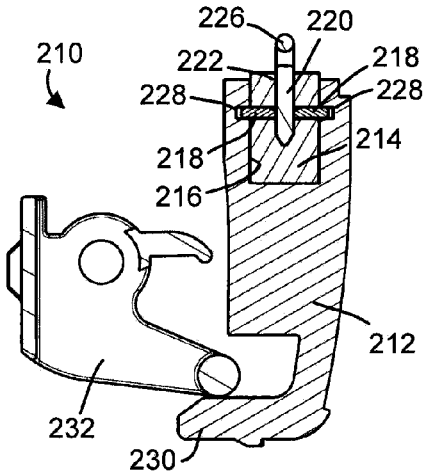
Figure 8C:
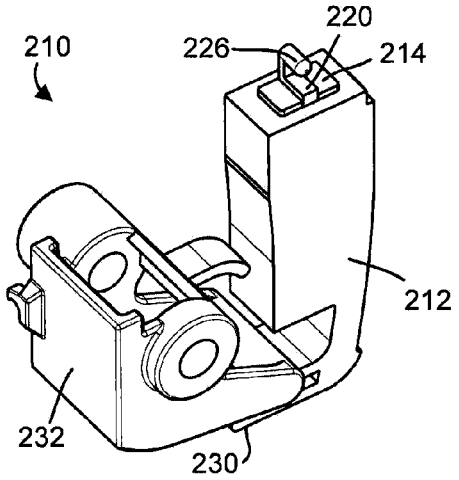
Figure 8D:
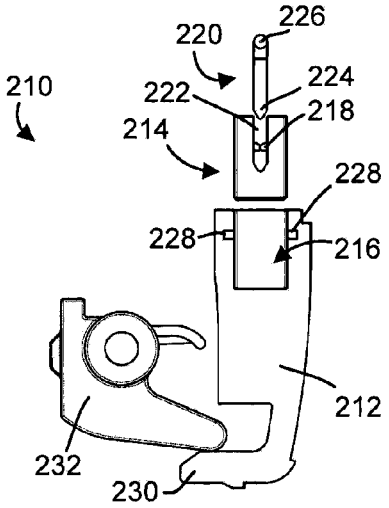

In the form illustrated, on one end, the pawl segment 212 includes a cavity 216 into which the handle strap segment 214 may be telescopically inserted. See, for example, the exploded view of FIG. 8D. The handle strap segment 214 includes a pair of transverse pins 218 which are, in the rest position, biased into the lateral sides of the strap segment 214. A pin wedge 220 is also insertable into a central opening 222 of the handle strap segment 214 along the telescopic axis, such that an angled surface on a tip 224 of the pin wedge 220 engages an angled surface of the transverse pins 218 in order to overcome the biasing force on the transverse pins 218 and to displace the transverse pins 218 laterally outward as best illustrated in FIG. 8B. The pin wedge 220 is attached to a linkage or the like by a tab 226 (disposed on the opposite end of the pin wedge 220 as the tip 224) which is attached to a handle grip or pad via a linkage, rocker, or the like.

When the strap segment 214 is received in cavity 216 of the pawl segment 212 and when the handle grip is depressed, the pin wedge 220 is inserted into central opening 222 of the handle strap segment 214. This insertion action thereby extends the pins 218 into receiving slots 228 in opposing sidewalls of the cavity 216 of the pawl segment 212, thereby locking the pawl segment 212 to the handle strap segment 214 as best illustrated in the cross-sectional view of FIG. 8B and as further depicted in FIGS. 8A, 8C, and 8F.

On the end of the pawl segment 212 opposite the cavity 216, the pawl segment 212 has a hook end 230. This hook end 230 is positioned for engagement with a latch cable release cam 232.

Figure 8E:
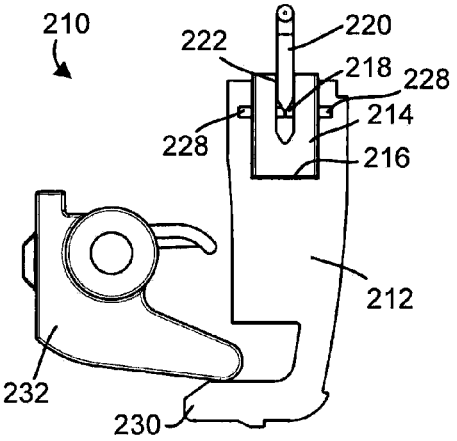
Figure 8F:
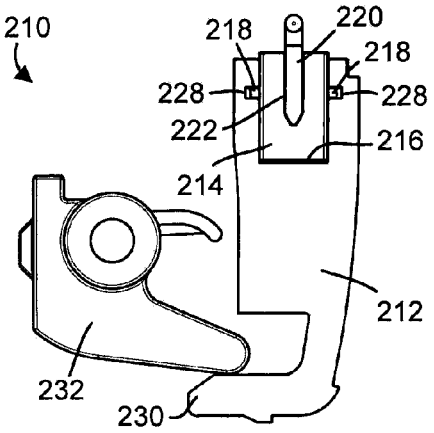

Now with reference to FIGS. 8E and 8F, the operation of the selective coupling mechanism 210 is described in greater detail. In FIG. 8E, the selective coupling mechanism 210 is illustrated in a "rest" position. In this position, the strap segment 214 is received in the cavity 216 of the pawl segment 216, but the pin wedge 220 is not fully inserted into the central opening 222 of the strap segment 214 (i.e., the handle grip or pad is not depressed so as to fully insert the pin wedge 220). As a result, the transverse pins 218 have not been extended out of the strap segment 214 and therefore the pawl segment 212 and the strap segment 214 are not locked together. In such a rest position, the movement of the connected handle strap (without the depression of the handle grip) causes the strap segment 214 to move relative to the pawl segment 212 without effectuating the movement of the pawl segment 212. Due to this de-coupling in the rest position, any movement of the strap segment 214 due to inertial forces from an accident or the like does not result in engagement of the pawl segment 212 with the latch cable release cam 232 in such a way as to release the latch.

However, once the pin wedge 220 is inserted into the strap segment 214 by the depression of a handle grip or pad, as illustrated in FIG. 8E, then the transverse pins 218 are extended into the receiving slots 228 of the cavity 216 of the pawl segment 212. After this locking engagement is initiated, then the further pulling of the handle strap will move the strap segment 214 and, accordingly, the pawl segment 212 to which it has become locked or coupled. This will cause the pawl segment 212 to move with the handle strap and cause the hook end 230 of the pawl segment 212 to engage the latch cable release cam 232 so as to release the latch.

Again, once the handle grip or pad is released, the pin wedge 220 is ejected, the transverse pins 218 return into the strap segment 214, and the pawl segment 212 and the strap segment 214 decouple from one another.

Figure 9A:
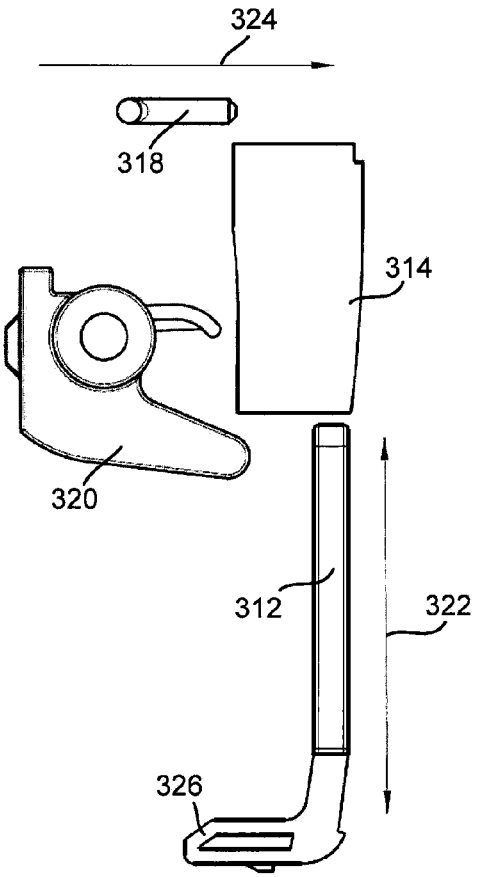
FIGS. 9A through 9C illustrate a release mechanism for a handle assembly in which a pin moves transversely to engage an aperture in a pawl and in which the pawl is movable in a direction generally perpendicular to the movement of the pin.
Figure 9B:
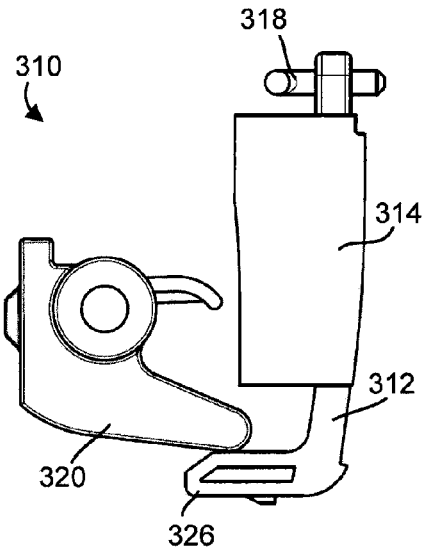
Figure 9C:
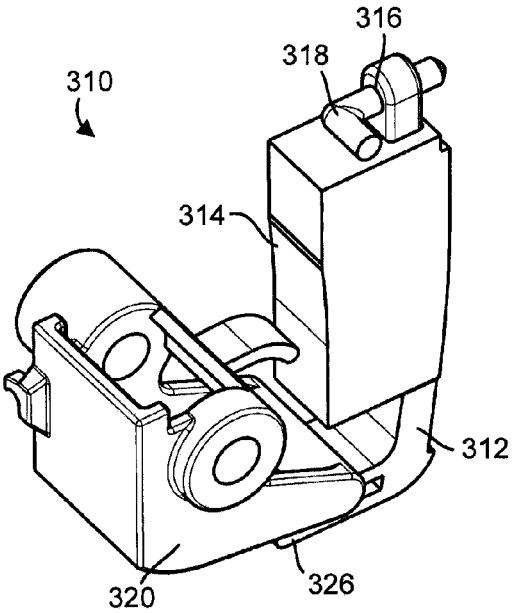

Turning now to FIGS. 9A through 9C, yet another configuration for a selective coupling mechanism 310 is illustrated. In this selective coupling mechanism 310, a pawl 312 is slidably received in through a sub-housing 314 (which may be a portion of the handle strap and move therewith). When the pawl 312 is received in the sub-housing 314, one end of the pawl 312 extends from a first side of the sub-housing 314. On this end, there is an aperture 316 formed in the pawl 312 (best shown in FIG. 9C) that extends transversely to the axis of insertion of the pawl 312 in the sub-housing 314. The aperture 316 is for selective engagement with a pin 318 that is, itself, actuatable in a direction perpendicular to the direction which the pawl 312 is slidingly received in the sub-housing 314. The other end of the pawl 312 extends from the second and opposite side of the sub-housing 314 and, on this end, there is a hook end 326 for selective engagement with a latch cable release cam 320.

The restricted directions of movement of the pawl 312 and the pin 318 are illustrated in FIG. 9A. The pawl 312 is movable in a first direction 322, over which the hook end 318 thereof can potentially engage and release the latch cable release cam 320. The pin 318 is movable in a second direction 324, that is perpendicular to the first direction 322, and over which the pin 318 can be inserted into or out of the aperture 316 of the pawl 312.

The pin 318 is attached to a linkage, rocker or the like that effectuates its movement based on a state of depression of a handle grip or pad. When the handle grip or pad is not depressed, the pin 318 is moved into a position in which the pin 318 does not interact with the aperture 316 on the pawl 312 such that the pawl 318 is not fixed relative to the sub-housing 314 and its attached handle strap. However, when the handle grip or pad is depressed, then the pin 318 is moved into interaction with the aperture 316 on the pawl 312 such that the pawl 312 moves with the sub-housing 314 (because the engagement with the pin 318 prevents the pawl 312 from substantially sliding relative to the sub-housing 314 when it moves).

Accordingly, the actuation of the handle pad or grip cause the pin 318 to enter or to be removed from the aperture 316 in the pawl 312 and thereby either couple or decouple the pawl 312 from the movement of the sub-housing 314 and its attached handle strap. When the two are coupled together, then the movement of the sub-housing 314 (by the further opening or pulling of the handle strap) will cause the hook end 318 of the pawl 312 to engage the latch cable release cam 320. When the pin 318 does not couple the pawl 312 to the sub-housing 314 and the handle strap, then an inertial load or force on the handle strap will not cause the pawl 312 to engage the latch cable release cam 320 so as to release the latch.

Figure 10A:
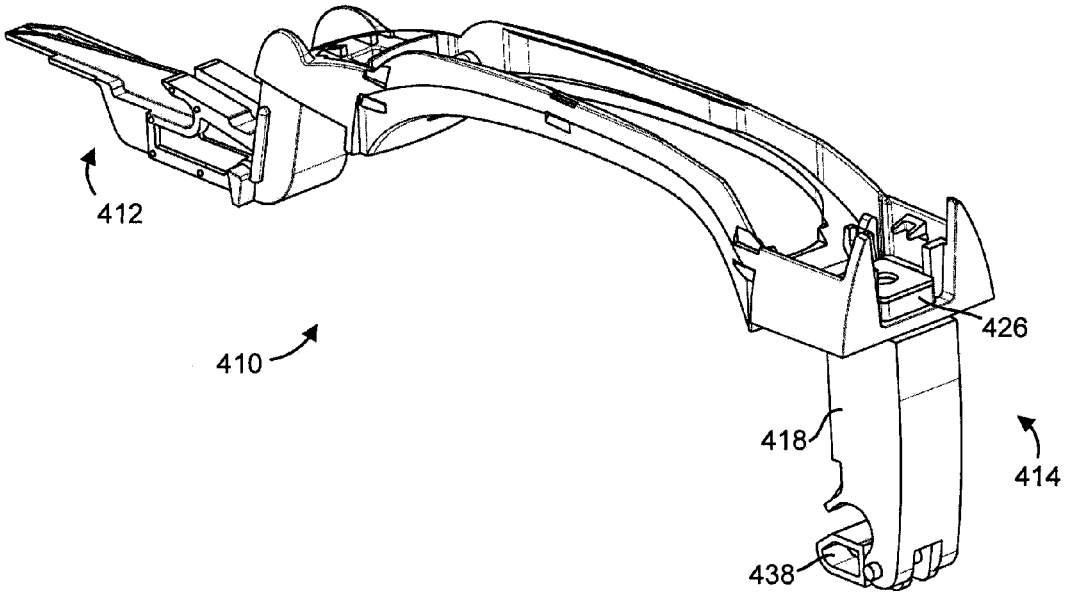
FIGS. 10A through 10D illustrate a handle strap for a handle assembly in which an electrically-activated leg is movable via a solenoid between an engaged position in which the leg engages the pawl (shown in the cross section of FIG. 10D) and a disengaged position in which the leg does not engage the pawl (shown in the cross section of FIG. 10C).
Figure 10B:
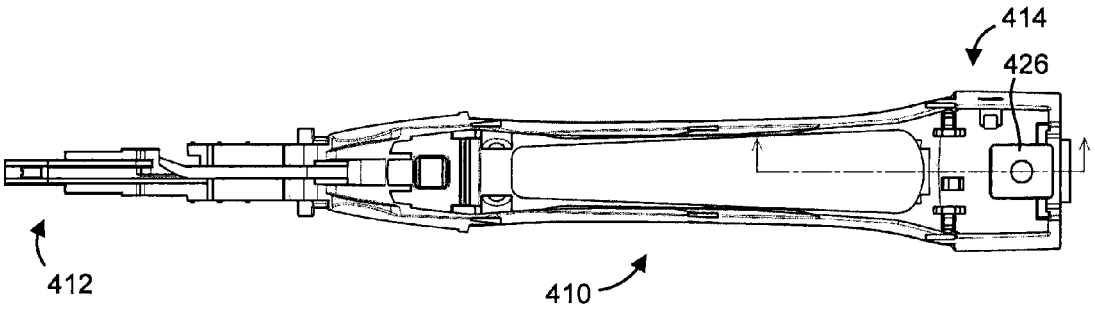

Turning now to FIGS. 10A through 10D, a handle strap 410 is illustrated which is combinable with a base as illustrated in the embodiment shown in FIGS. 1 through 6 to form a handle assembly. As with the previously-described handle strap from FIGS. 1 through 6 and as is best illustrated in FIGS. 10A and 10B, the handle strap 410 extends from a base end 412 to a handle end 414 such that, when the handle strap 410 is coupled to a base of a handle assembly, the handle strap 410 is pivotal about the base end 412 when the handle strap 410 is pulled.

However, unlike the earlier-described handle strap, the handle strap 410 includes an electrically-activated leg 416 instead of solely using mechanical linkages to actuate a leg.

Figure 10C:
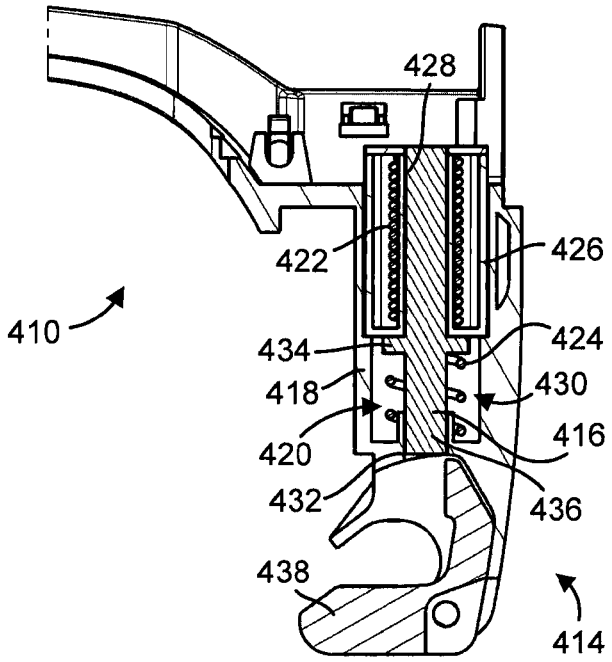
Figure 10D:
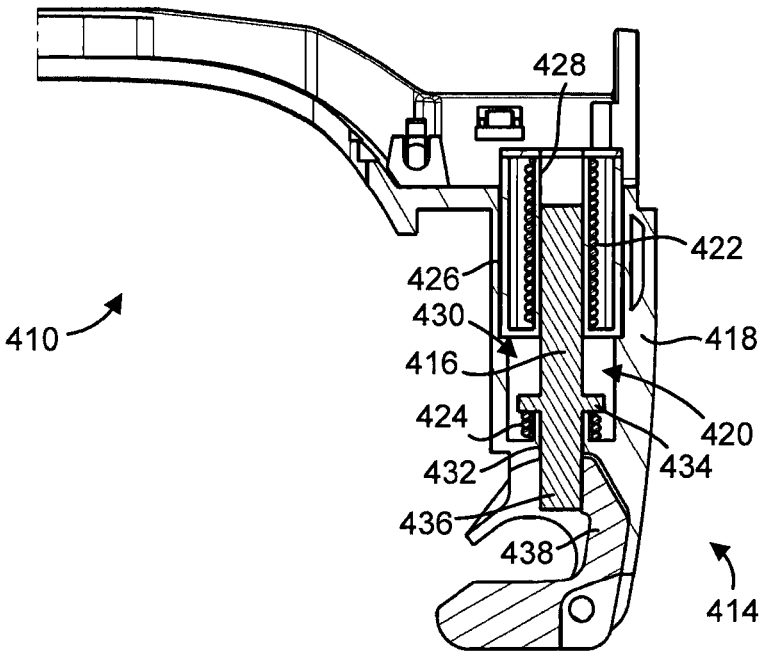

In the particular form illustrated, the electrically-activated leg 416 is received in and extends through a handle tower 418 on the handle end 414 of the handle strap 410. As best illustrated in FIGS. 10C and 10D, the handle tower 418 is formed to include a hollow cavity 420 in which a sub-assembly including a solenoid 422, the electrically-activated leg 416, and a biasing spring 424 is inserted. The solenoid 422 is received in a housing 426 that is inserted in one end of the hollow opening 420. The housing 426 has an opening 428 that extends axially through the housing 426 and around which the solenoid 422 is wrapped. The housing 426 containing the solenoid 422 is received in the hollow cavity 420 such that there is a space 430 in the hollow cavity 420 between the bottom of the hollow cavity 420 and the lower end of the housing 426.

In this space 430, the electrically-activated leg 416 is received. The electrically-activated leg 416 is a pin that linearly extends, at least in part through the opening 428 in the housing 426 containing the solenoid 422 and is also capable of extending from an opening 432 on the bottom of the hollow cavity 420. In the form illustrated, the electrically-activated leg 416 includes a flange 434 centrally disposed between the ends of the electrically-activated leg 416. This flange 434 is positioned in the space 430 between the bottom of the housing 426 of the solenoid 422 and the bottom of the hollow cavity 420. This flange is large enough that it prevents the entirety of the electrically-activated leg 416 from passing through the opening 432 in the bottom of the hollow cavity 420, although it does permit a terminal end portion of the electrically-activated leg 416 to extend from the opening 432 as illustrated in FIG. 10C. Likewise, this flange 434 prevents the entirety of the electrically-activated leg 416 from passing through the opening 428 in the housing 426 containing the solenoid 422. As shown in FIG. 10D, the flange 434 permits a portion of the electrically-activated leg 416 to enter the center of the solenoid 422, but prevents the electrically-activated leg 416 from fully passing through this opening 428. Accordingly, this flange 434 captures the electrically-activated leg 416 within the handle tower 418 such that a portion of the electrically-activated leg 416 is always in the solenoid 422 and an end portion 436 of the electrically-activated leg 416 is extendable from the opening 432 of the handle tower 418 to selectively engage an actuation pawl 438.

As illustrated in FIG. 10C, the biasing spring 424 is disposed between the flange 434 and the bottom of the hollow cavity 420 to generally bias the electrically-activated leg 416 into the opening 428 of the housing containing the solenoid 422. In this disengaged position, the end portion 436 of the electrically-activated leg 416 is retracted into the handle tower 418 and the end portion 436 of the electrically-activated leg 416 does not engage the actuation pawl 438. As in the embodiment of FIGS. 1 through 6, if the electrically-activated leg 416 does not engage the pawl 438 and if the handle strap 410 is further moved, then the pawl 438 is permitted to rotate past a door latch release.

As illustrated in FIG. 10D, when the solenoid 422 is electrically activated, then the electrically-activated leg 416 overcomes the force of the biasing spring 424 to move the end portion 436 of the electrically-activated leg 416 out of the opening 432 to engage the pawl 438. In this engaged position, the end portion 436 of the electrically-activated leg 416 is extended from the handle tower 418 and the end portion 436 of the electrically-activated leg 416 does engage the actuation pawl 438 to prevent it from rotating. As in the embodiment of FIGS. 1 through 6, if the electrically-activated leg 416 engages the pawl 438 and if the handle strap 410 is moved, then the pawl 438 catches a door latch release to open the door.

Figure 11:
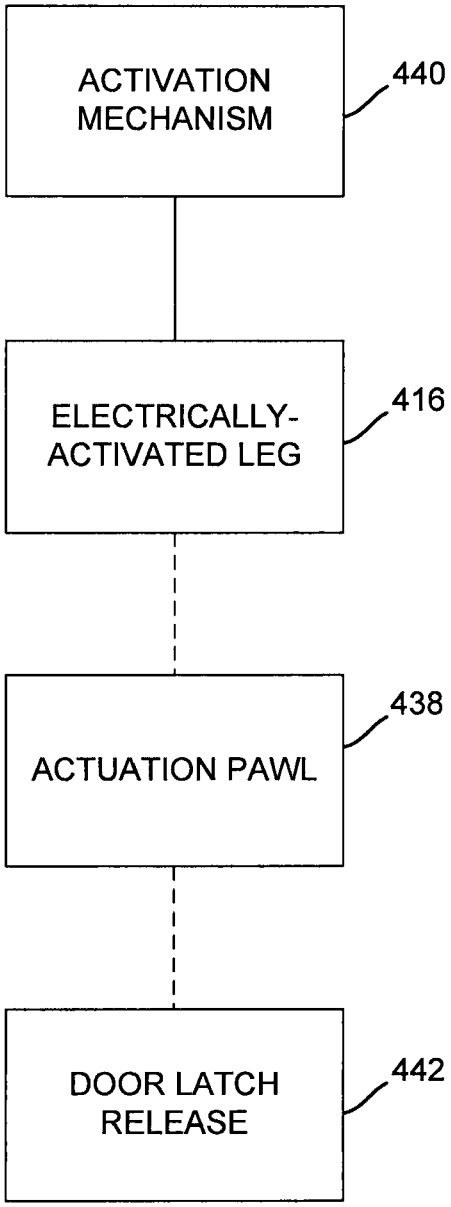
FIG. 11 schematically illustrates the connection between an activation mechanism, an electrically-activated leg such as in the handle strap of FIGS. 10A through 10D, an actuation pawl, and a door latch release.

Now with additional reference to FIG. 11, an explanation of how the electrically-activated leg 416 is actuated is provided. From FIG. 11, it can be seen that an activating mechanism 440 is in communication with the electrically-activated leg 416. This activating mechanism 440 could be a, number of mechanisms such as, for example, a capacitive field activation mechanism (such as a mechanism that detects the presence of a user's hand around the handle strap as the result of a change in the capacitive field) or an electromechanical switch (which may include, for example, a handle grip actuatable relative to the handle strap in which an actuation of the handle grip operates the electromechanical switch). When the activating mechanism 440 is activated (by, for example, placing a user's hand around the handle strap or depressing a handle grip to actuate an electromechanical switch), then this causes the electrically-activated leg 416 to move. In one form, this is done by providing an electrical signal to a device that provides a current to the solenoid 422 to cause the leg 416 to move from a disengaged position as illustrated in FIG. 10C to an engaged position such as illustrated in FIG. 10D. Once the activation mechanism 440 is no longer in use (for example, a hand is removed from the area around the handle strap or a handle grip is released), then the solenoid 422 may no longer have a current applied to it and the electrically-activated leg 416 may return to the disengaged position of FIG. 10C.

As illustrated by the dotted lines in FIG. 11, if the leg 416 is activated, then a temporary connection or engagement occurs between the leg 416 and the pawl 438. When this happens (that is, the leg 416 engages the pawl 438 to make the pawl 438 non-rotatable), then the pawl 438 moves with the handle strap 410 and can catch the door release latch 442 to open the door. If, however, the leg 416 is not electrically activated and is in the disengaged position, then the leg 416 is not connected to or engagement with the pawl 438 and the pawl 438 is rotatable under low or minimal loads. If this is the case then, if the handle strap 410 is moved, the pawl 438 will be permitted rotate past the door latch release 442 and the door will not open.

It should be appreciated that although an electrically-activated leg moved by a solenoid is illustrated, that the electrically-activated legs may be moved in other electrical ways other than using an solenoid or that the activation mechanism may be different than those described above.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A handle assembly for preventing inadvertent opening of a motor vehicle door during a crash event, said handle assembly comprising:

a base fixedly secured to the motor vehicle door;

a handle strap extending between a handle end and a base end in which the handle strap is pivotal about the base end and in which the handle end extends through an aperture in the base;

an electrically-activated leg extending through the handle end of the handle strap;

an actuation pawl for selective engagement and actuation with a door latch release, the actuation pawl disposed proximate a free end of the electrically-activated leg and being rotatably attached to the handle end of the handle strap such that the door latch release rotates the actuation pawl; and an activation mechanism coupled to the electrically-activated leg;

wherein, when the activation mechanism is activated, then the electrically-activated leg is moved to a first position to engage the actuation pawl to prevent rotation of the actuation pawl so that, upon actuation of the handle strap, the actuation pawl engages and actuates the door latch release.

2. The handle assembly of claim 1, wherein, when the activation mechanism is not activated, then the electrically-activated leg is in a second position in which the electrically-activated leg does not engage the actuation pawl and the actuation pawl is permitted to rotate such that a movement of the handle strap does not cause the actuation pawl to actuate the door release latch.

3. The handle assembly of claim 2, wherein, when the activation mechanism is not activated such that the electrically-activated leg does not engage the actuation pawl and when inertial forces or other crash induced forces are further applied to the handle assembly, the movement of the handle strap does not cause the actuation pawl to actuate the door release latch.

4. The handle assembly of claim 1, wherein the electrically-activated leg is actuatable between the first position in which the electrically-activated leg engages the actuation pawl and a second position in which the electrically-activated leg does not engage the actuation pawl, and the activation mechanism further comprising a solenoid that actuates the electrically-activated leg to the first position.

5. The handle assembly of claim 4, further comprising a biasing spring that biases the electrically-activated leg to the second position in which the electrically-activated leg does not engage the actuation pawl and wherein the solenoid actuates the electrically-activated leg against the biasing spring from the second position to the first position in which the electrically-activated leg engages the actuation pawl.

6. The handle assembly of claim 4, wherein the electrically-activated leg is telescopically received inside the solenoid.

7. The handle assembly of claim 4, wherein the solenoid is received in a housing and the electrically-activated leg is received in an opening extending through the housing.

8. The handle assembly of claim 7, wherein the housing is received in the handle end of the handle strap and the electrically-activated leg is captured between the housing and the handle end of the handle strap, but movable therewithin such that an end of the electrically-activated leg is extendable from the handle end to selectively engage the actuation pawl.

9. The handle assembly of claim 1, wherein the activation mechanism includes a capacitive field activation mechanism.

10. The handle assembly of claim 1, wherein the activation mechanism includes an electromechanical switch.

11. The handle assembly of claim 10, further comprising a handle grip actuatable relative to the handle strap and wherein an actuation of the handle grip operates the electromechanical switch.

12. The handle assembly of claim 1, wherein, when the activation mechanism is not activated, the actuation pawl is rotatable with minimal to no load and thus does not transmit appreciable force to the door latch release.

13. The handle assembly of claim 1, wherein the activation mechanism is electrically coupled to the electrically-activated leg.

14. The handle assembly of claim 1, wherein the actuation pawl rotates the door latch release.

15. The handle assembly of claim 1, wherein the actuation pawl is rotatable about the handle end of the handle strap.

16. A handle assembly for preventing inadvertent opening of a motor vehicle door during a crash event, said handle assembly comprising:

a base fixedly secured to the motor vehicle door;

a handle strap extending between a handle end and a base end in which the handle strap is pivotal about the base end and in which the handle end extends through an aperture in the base;

an electrically-activated leg extending through the handle end of the handle strap;

an actuation pawl for selective engagement and actuation with a door latch release, the actuation pawl disposed proximate a free end of the electrically-activated leg and being rotatably attached to the handle end of the handle strap;

an activation mechanism coupled to the electrically-activated leg and including a solenoid that actuates the electrically-activated leg to a first position in which the electrically-activated leg engages the actuation pawl; and a biasing spring that biases the electrically-activated leg to a second position in which the electrically-activated leg does not engage the actuation pawl and wherein the solenoid actuates the electrically-activated leg against the biasing spring from the second position to the first position, wherein, when the activation mechanism is activated, then the electrically-activated leg is moved to the first position to engage the actuation pawl to prevent rotation of the actuation pawl so that, upon actuation of the handle strap, the actuation pawl engages and actuates the door latch release.

17. A handle assembly for preventing inadvertent opening of a motor vehicle door during a crash event, said handle assembly comprising:

a base fixedly secured to the motor vehicle door;

a handle strap extending between a handle end and a base end in which the handle strap is pivotal about the base end and in which the handle end extends through an aperture in the base;

an electrically-activated leg extending through the handle end of the handle strap;

an actuation pawl for selective engagement and actuation with a door latch release, the actuation pawl disposed proximate a free end of the electrically-activated leg and being rotatably attached to the handle end of the handle strap; and an activation mechanism coupled to the electrically-activated leg and including a solenoid that actuates the electrically-activated leg to a first position in which the electrically-activated leg engages the actuation pawl, the electrically-activated leg telescopically received inside the solenoid;

wherein, when the activation mechanism is activated, then the electrically-activated leg is moved to a first position to engage the actuation pawl to prevent rotation of the actuation pawl so that, upon actuation of the handle strap, the actuation pawl engages and actuates the door latch release, and wherein the electrically-activated leg is actuatable between the first position and a second position in which the electrically-activated leg does not engage the actuation pawl.

18. A handle assembly for preventing inadvertent opening of a motor vehicle door during a crash event, said handle assembly comprising:

a base fixedly secured to the motor vehicle door;

a handle strap extending between a handle end and a base end in which the handle strap is pivotal about the base end and in which the handle end extends through an aperture in the base;

an electrically-activated leg extending through the handle end of the handle strap;

an actuation pawl for selective engagement and actuation with a door latch release, the actuation pawl disposed proximate a free end of the electrically-activated leg and being rotatably attached to the handle end of the handle strap; and an activation mechanism coupled to the electrically-activated leg and including a solenoid that actuates the electrically-activated leg to a first position in which the electrically-activated leg engages the actuation pawl, the solenoid being received in a housing and the electrically-activated leg being received in an opening extending through the housing;

wherein, when the activation mechanism is activated, then the electrically-activated leg is moved to a first position to engage the actuation pawl to prevent rotation of the actuation pawl so that, upon actuation of the handle strap, the actuation pawl engages and actuates the door latch release, and wherein the electrically-activated leg is actuatable between the first position and a second position in which the electrically-activated leg does not engage the actuation pawl.

* * * * *